United States Patent [19]

Yeang-Yai

[11] Patent Number: 4,942,637

[45] Date of Patent: Jul. 24, 1990

[54] DOUBLE-PURPOSE HAND TOOL

[76] Inventor: Her Yeang-Yai, Room, 10, Floor 2, No. 8, Lane 38, Nan Ho Rd., Taichung, Taiwan

[21] Appl. No.: 423,815

[22] Filed: Oct. 18, 1989

[51] Int. Cl.[5] ..... B25B 7/32

[52] U.S. Cl. ..... 7/135; 7/158

[58] Field of Search ..... 7/118, 127, 129, 131, 7/135, 158

[56] References Cited

U.S. PATENT DOCUMENTS

| | | | |
|---|---|---|---|
| 1,460,837 | 7/1923 | Bangert et al. | 7/131 |
| 2,446,022 | 7/1948 | Peterson | 7/131 X |
| 2,967,303 | 1/1961 | Wise | 7/131 X |
| 4,669,140 | 6/1987 | Miceli | 7/158 |

*Primary Examiner*—James G. Smith

*Attorney,. Agent, or Firm*—Browdy and Neimark

[57] ABSTRACT

Disclosed is a double-purpose hand tool comprising two action members pivotably coupled together by a pivot substantially at their middle portions, the two action members being formed with a pair of shear portions at two corresponding ends thereof and a pair of plier portions at the other two corresponding ends thereof; a biasing means associated with the two action members which can bias the pair of shear portions apart and can bias the pair of plier portions apart; and two grip members, each of them being pivoted about the pivot at one of its ends and formed with a space and an abutment portion therein so that each of the two shear portions can be received in its related space and abut against its related abutment portion to expose the two plier portions, and each of the two plier portions can be received in its related space and abut against its related abutment portion to expose the two shear portions.

7 Claims, 3 Drawing Sheets

DOUBLE-PURPOSE HAND TOOL

BACKGROUND OF THE INVENTION

This invention relates to a double-purpose hand tool, specifically a hand tool which can be used as either a pair of scissors or a pair of pliers.

In daily life, hand tools are frequently needed for some works. Generally speaking, pairs of scissors and of pliers are widely used hand tools. Thay are usually bought separately and incur high costs. Moreover, sometimes in use, they must be used in interchang way and cause inconvenience. Therefore, the necessity of a double-purpose hand tool of the aforementioned type has been in existence.

Accordingly, the primary object of the invention is to provide a hand tool which can be used as either a pair of scissors or a pair of pliers.

BRIEF SUMMARY OF THE INVENTION

To achieve this object, a double-purpose hand tool in accordance with this invention comprises two action members. They are formed with two through holes at their middle portions respectively, a pair of plier portions, and a pair of shear portions. The hand tool also comprises two grip members. Each of the grip members consist of two shuttle-like parallel walls. Two corresponding ends of the walls are joined by an abutment portion and at the opposite two corresponding ends are formed with two through holes respectively for receiving a pivot bolt. A spiral bolt is associated with the action members so that after the action members and grip members are assembled together by a pivot bolt inserted through the related holes and a nut threaded on one end of the bolt, the spring can bias the action members into a position in which they have an appropriate angle with respect to each other. The space between the walls of one of the grip members is large enough to partly receive the other grip member. At the wall edge portions of one of the grip members adjacent the related abutment portion are formed with wavelike portions. At the free end of the other grip member is formed with a hole traversely extending through the related abutment portion. The free limbs of an open loop shackle of elastic material and substantially rectangular shape are inserted in the through hole from two sides of the grip member respectively. One of the action members is provided with a lug at the middle portion thereof. A catch is pivotably attached to the other action member at an appropriate location thereon so that when the action members are in their closed position, the catch can be pivoted to the position in which the lug can be retained by the catch to prevent the action members from being biased apart by the spring with respect to each other.

BRIEF DESCRIPTION OF THE DRAWINGS

A preferred embodiment of the invention will now be described by way of example and with reference to the accompanying drawings, in which.

DETAILED DESCRIPTION OF THE INVENTION

Figure 1:
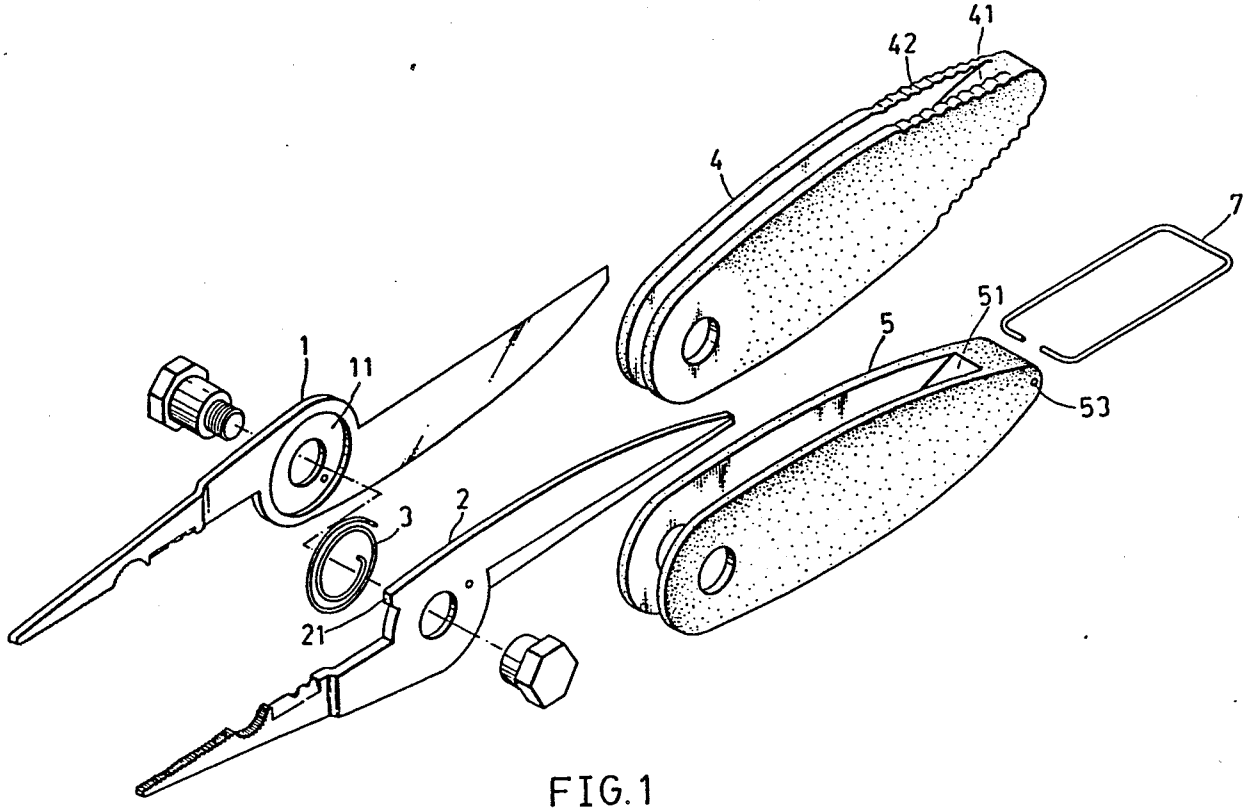
FIG. 1 is an exploded pictorial view showing the preferred embodiment of the invention.
Figure 2:
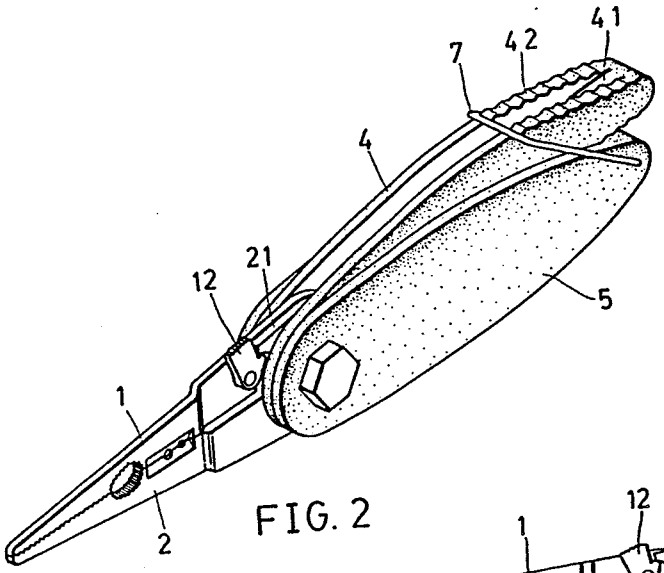
FIG. 2 is a pictorial view showing the preferred embodiment in a state ready for use as a pair of pliers.

Referring to FIGS. 1 and 2, a double-purpose hand tool in accordance with this invention comprises two action members 1 and 2. Each of these members has a shallow recess 11 substantially in the middle portion of the surface facing the other member and each recess 11 is formed with a through hole at the central portion thereof. The left-hand side (FIG. 1) of the two members 1 and 2 are formed into a pair of plier portions, and the right-hand side a pair of shear portions. The hand tool also comprises two grip members 4 and 5. The grip member 4 (likewise 5) consists of two shuttle-like parallel walls. Two corresponding ends of the walls are joined by an abutment portion 41 (likewise 51) and at the opposite two corresponding ends are formed with two through holes respectively for receiving a bolt. When the middle portions of the members 1 and 2 abut each other, the recesses 11 define a space for accomodating a spiral spring 3, the ends of which being secured to the recessed surfaces of members 1 and 2 respectively so that after the action members 1, 2 and the grip members 4, 5 are assembled together by a pivot bolt inserted through the related holes and a nut threaded on one end of the bolt, the spring 3 can bias the action members into a position in which they have an appropriate angle with respect to each other. The space between the walls of the grip member 5 is large enough to partly receive the grip member 4, as illustrated in FIG. 2. At the wall edge portions adjacent the abutment portion 41 are formed with vavelike portions 42. At the free end of the grip member 5 is formed with a hole 53 traversely extending through the abutment portion. The free limbs of an open loop shackle 7 of elastic material and substantially rectangular shape are inserted in the through hole 53 from two sides of the grip member 5 respectively. The action member 2 is provided with a lug 21 substantially at the middle portion thereof as shown in FIG. 1. A catch 12 is pivotably attached to the action member 1 at an appropriate location thereon so that when the action members 1 and 2 are in their closed position as shown in FIG. 2, the catch 12 can be pivoted to the position in which the lug 21 is retained by the catch 12 to prevent the action members 1 and 2 from being pivoted apart with respect to each other.

Figure 5:
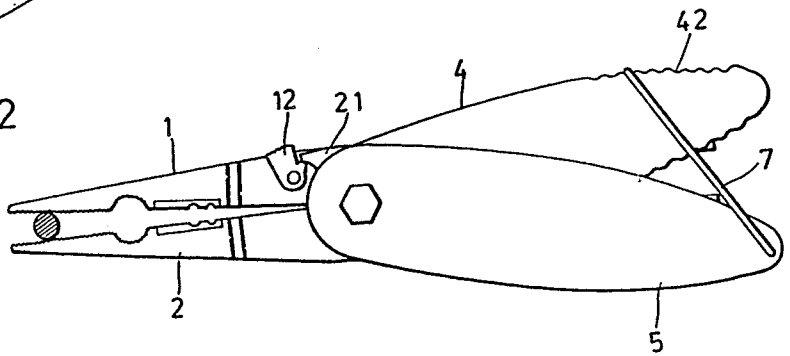
FIG. 5 is still another schematic view illustrating the use of the preferred embodiment.
Figure 3:
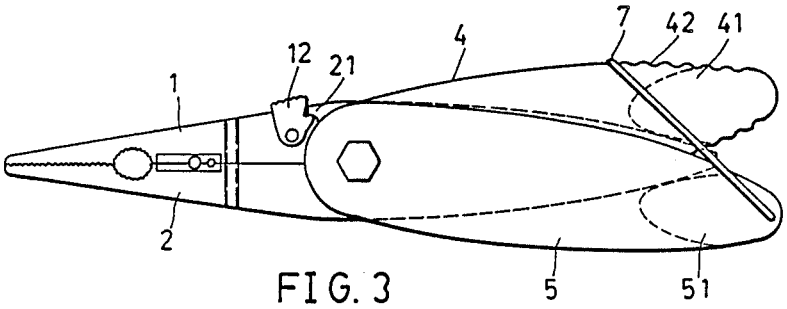
FIG. 3 is a schematic view illustrating the use of the preferred embodiment.
Figure 4:
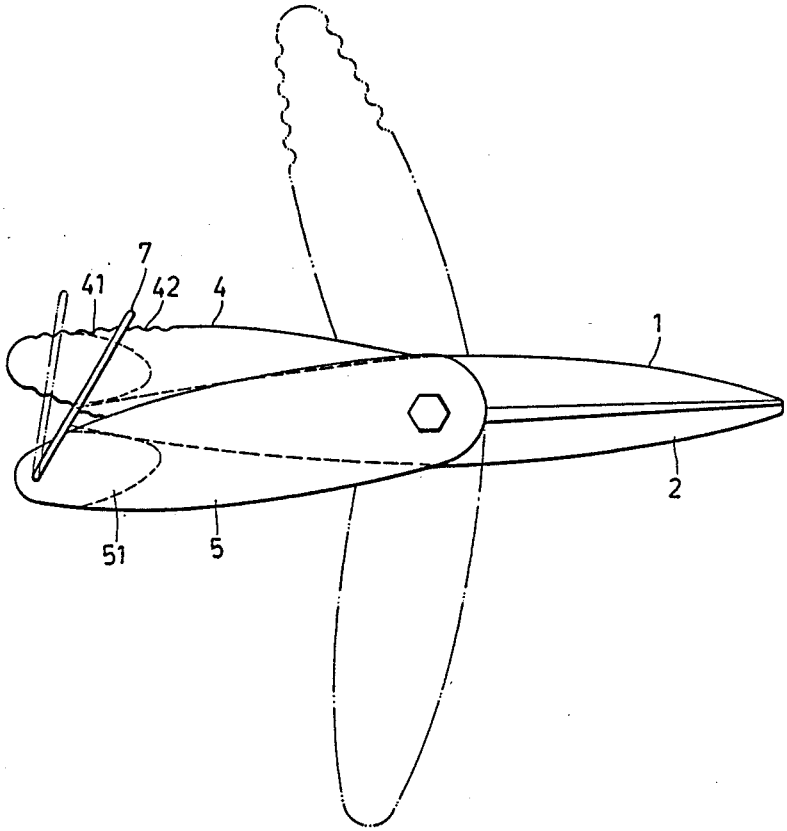
FIG. 4 is another schematic view illustrating the use of the preferred embodiment.

In use, the grip members 4 and 5 can be pivoted, as illustrated by phantom lines in FIG. 4, from a position in which the tool can be used as a pair of pliers as shown in FIG. 3 to a position in which the tool can be used as a pair of scissors as shown by solid lines in FIG. 4. Moreover, the grip members 4 and 5 can be kept in a desired relative position by the engagement between the shackle 7 and the related wavelike portions, as illustrated in FIG. 5.

While only one preferred embodiment of the invention has been shown and described, it will be understood that this invention is not limited thereto since modifications can be made and will become apparent to those skilled in the art.

I claim:

1. A double-purpose hand tool comprising:

two action members pivotally coupled together by a pivot substantially at their middle portions, said two action members being formed with a pair of shear portions at two corresponding ends thereof and a pair of plier portions at the other two corresponding ends thereof;

a biasing means associated with said two action members which can bias said pair of shear portions apart and can bias said pair of plier portions apart; and two grip members, each of them being pivoted about said pivot at one of its ends and formed with a space and an abutment portion therein so that each of said two shear portions can be received in its related space and abut against its related abutment portion to expose said two plier portions, and each of said two plier portions can be received in its related space and abut against its related abutment portion to expose said two shear portions.

2. A double-purpose hand tool according to claim 1, wherein a space is formed about the pivot between said two action members for receiving said biasing means.

3. A double-purpose hand tool according to claim 1, further comprising catch means associated with said two action members, which catch means being capable of preventing said two action members from being pivoted apart by said biasing means.

4. A double-purpose hand tool according to claim 3, wherein said catch means includes a first fastening member fixedly attached to the first one of said two action members adjacent said pivot and a second fastening member movably attached to the second one of said two action members at an appropriate location.

5. A double-purpose hand tool according to claim 4, wherein said first fastening member is a lug integrally formed with said first action member, and said second fastening member is a catch pivotably attached to said second action member and formed with an indentation for retaining said lug.

6. A double-purpose hand tool according to claim 1, further comprising a locating means provided on the ends of said grip members remote from said pivot.

7. A double-purpose hand tool according to claim 6, wherein said locating means includes a wavelike portion provided on one of said ends and a shackle pivotably attached to the other one of said ends.

* * * * *